United States Patent [19]

Nixon

[11] Patent Number: 4,623,882

[45] Date of Patent: Nov. 18, 1986

[54] FLUORESCENT DISPLAY ARRANGEMENT HAVING FIELD ELECTRODE ADJACENT CATHODE

[75] Inventor: Ralph D. Nixon, Braintree, United Kingdom

[73] Assignee: English Electric Valve Company Limited, Chelmsford, England

[21] Appl. No.: 520,248

[22] Filed: Aug. 4, 1983

[30] Foreign Application Priority Data

Aug. 6, 1982 [GB] United Kingdom ..... 8222740

[51] Int. Cl.[4] ..... G09G 3/12

[52] U.S. Cl. ..... 340/760; 340/761; 340/781; 313/410; 313/513

[58] Field of Search ..... 340/760, 761, 781, 720, 340/732; 313/400, 410, 513

[56] References Cited

U.S. PATENT DOCUMENTS

| | | | |
|---|---|---|---|
| 3,673,448 | 6/1972 | Nakamura | 313/410 |
| 3,958,150 | 5/1976 | Kobayakana et al. | 340/760 |
| 4,004,186 | 1/1977 | Bylander | 313/513 |
| 4,070,599 | 1/1978 | Uchikoba et al. | 313/513 |
| 4,227,117 | 10/1980 | Watanabe et al. . | |
| 4,243,986 | 1/1981 | Nixon | 313/513 |
| 4,280,125 | 7/1981 | Kazan | 340/781 |
| 4,306,178 | 12/1981 | Nixon | 313/410 |

FOREIGN PATENT DOCUMENTS

| | | |
|---|---|---|
| 913963 | 12/1962 | United Kingdom . |
| 947197 | 1/1964 | United Kingdom . |
| 1536776 | 12/1978 | United Kingdom . |
| 2031219 | 4/1980 | United Kingdom . |
| 2058.444 | 4/1981 | United Kingdom. |
| 2061613 | 5/1981 | United Kingdom . |

*Primary Examiner*—Gerald L. Brigance

*Attorney, Agent, or Firm*—Spencer & Frank

[57] ABSTRACT

A display arrangement utilizes a fluorescent screen 3 to provide readily alterable bright displays. The arrangement can provide a fairly large display surface, but can be of very small thickness. It contains electron emissive cathodes 5, and field electrodes 7 positioned closely adjacent to the cathode to control the emission of free electrons. Electrons which are freely emitted are accelerated to a mesh electrode 4 which is held at a modest positive voltage. A fluorescent screen 3 having a positive potential of several thousand volts is positioned closely in front of the mesh electrode. In preferred embodiments of the invention, a number of separate cathodes and/or separate field electrodes are provided, so that selected regions of the screen can be illuminated to provide desired display patterns. Individual regions of the screen can be switched on and off (i.e. rendered bright or dark) by the application of very low switching potentials to the field electrodes and/or the cathodes.

11 Claims, 5 Drawing Figures

FLUORESCENT DISPLAY ARRANGEMENT HAVING FIELD ELECTRODE ADJACENT CATHODE

BACKGROUND AND SUMMARY OF THE INVENTION

This invention relates to a display arrangement which is capable of presenting bright, but readily alterable displays with modest power consumption and without being excessively bulky.

According to a first aspect of this invention a display arrangement includes a sealed envelope containing a mesh electrode positioned between an electron emissive cathode arranged to emit a divergent flood beam of electrons and a fluorescent screen which forms part of the envelope so that the flood beam falls upon a predetermined area of said mesh electrode; and field electrode means positioned closely adjacent to the cathode for controlling the strength and polarity (with respect to the cathode) of the electric field in which the cathode is situated, so as to determine whether or not electrons are able to reach said screen to cause it to fluoresce.

According to a second aspect of this invention, a display arrangement includes a sealed envelope containing a mesh electrode positioned between an electron emissive cathode arranged to emit a divergent flood beam of electrons and a fluorescent screen which forms part of the envelope so that the flood beam falls upon a predetermined area of said mesh electrode; and field electrode means positioned so that the cathode is between at least a part of said means and said mesh electrode, the field electrode means being positioned closely adjacent to the cathode for controlling the strength and polarity (with respect to the cathode) of the electric field in which the cathode is situated so as to determine whether or not electrons are able to reach said screen to cause it to fluoresce.

The strength and polarity of the electric field in which the electron emissive cathode is situated is dependent on the potential of the cathode itself as well as the potentials on the mesh electrode and the field electrode. Since the potential on the mesh electrode is primarily dictated by other considerations, it is preferable to use the potential upon the field electrode to control the passage of electrons from the cathode to the fluorescent screen. By arranging that the electron emissive cathode is situated in an electric field which is more negative than the potential of the cathode, free electron emission is inhibited, and electrons are tightly confined to the vicinity of the cathode surface and thus are unable to reach the fluorescent screen. Conversely, by altering the polarity of the electric field with respect to the cathode, electrons are freely emitted and accelerated towards the mesh electrode which is at a potential somewhat more positive than that of the cathode. Once they reach this mesh electrode the electrons are rapidly accelerated towards the fluorescent screen, which typically has a potential of several thousand volts upon it. Increasing the magnitude of the electric field provides a control over the quantity of electrons which reach the screen and hence the brightness of the display, although the brightness is primarily dependent on the magnitude of the accelerating potential on the screen. The presence of the mesh electrode effectively isolates the cathode and the field grid from the effects of the high potential on the screen, and thus the display can be switched on and off by means of very low voltages in a rapid and reliable fashion.

According to a third aspect of this invention a method of operating a display arrangement comprising a sealed envelope containing a mesh electrode positioned between an electron emissive cathode arranged to emit a divergent flood beam of electrons and a fluorescent screen which forms part of the envelope so that the flood beam falls upon a predetermined area of said mesh electrode; and field electrode means positioned so that the cathode is between at least a part of said means and said mesh electrode, the field electrode means being positioned closely adjacent to the cathode for controlling the strength and polarity (with respect to the cathode) of the electric field in which the cathode is situated so as to determine whether or not electrons are able to reach said screen to cause it to fluoresce, includes the steps of applying a first predetermined potential difference between the field electrode means and the cathode so as to cause the divergent flood beam of electrons of predetermined size to be emitted from said cathode so as to cause fluoresence of said screen; and applying a second selectable predetermined potential difference between the field electrode means and the cathode so as to prevent electrons reaching the mesh electrode.

The invention avoids the need to position control electrodes between a cathode structure and the screen to achieve selective illumination thereof, and it permits the thickness of a display arrangement to be very small indeed, since the control electrode, which comprises, in effect, the field electrode, can be positioned on that side of the cathode which is remote from the screen. Advantageously, one or both of the cathode and the field electrode are of a segmented nature, so that the selection of particular segments constrains electrons to call upon selected locations of the screen to permit complex display patterns to be generated and rapidly altered. In principle, the mesh electrode can be of a segmented nature, so that it can also be used to selectively address locations of the fluorescent screen, but this is less preferred.

The display arrangements can take a number of different physical forms. For example, it can be arranged to generate a stylised symbol or character, usually a seven stroke character based upon the numeral eight. Alternatively, it can be used to select from a matrix of possible points or small patches of light just those points which act together to represent the required display pattern. Other variations are described subsequently with reference to the drawings. The use of an appropriate fluorescent screen enables a colour display to be provided, if necessary.

DESCRIPTION OF PREFERRED EMBODIMENTS

Figure 1:
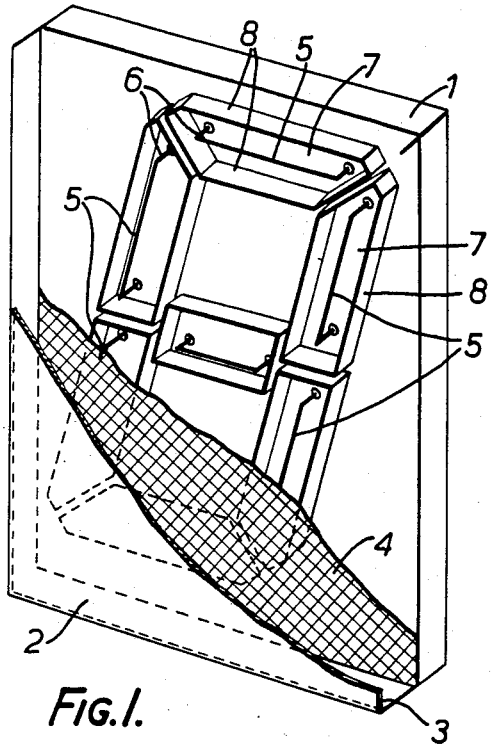
FIG. 1 shows a display arrangement in accordance with the invention.

Referring to FIG. 1, it represents a seven stroke character arranged to display a stylised numeral eight. Stylised characters of this kind are now very well known, and by selectively energising different combinations of strokes, any of the numerals nought to nine can be formed. The arrangement comprises a sealed envelope 1 in the form of a thin rectangular box having a front plate 2, which carries a fluorescent screen 3 upon its inner surface. A mesh electrode 4 is mounted immediately in front of the screen 3, but is spaced apart slightly from it and mounted so as to be electrically insulated from the screen. Typically, the envelope 1 is formed of glass which intrinsically is an excellent electrical insulator. This is an important consideration as, in operation, a potential difference of several thousand volts exists between the fluorescent screen 3 and the mesh electrode 4. A cathode structure is mounted closely behind the mesh electrode 4, and the cathode structure consists of several individual cathode filaments 5 mounted under tension between a pair of conductive pins 6, which project through respective field electrodes 7, which take the form of conductive back plates. Each cathode filament 5 is surrounded by conductive walls 8, which are attached to the back plates and which lie between the field electrode 7 and the mesh electrode 4. The mesh electrode is electrically insulated from the walls 8.

In operation, the field electrode 7, the cathode filaments 5, and the mesh electrode 4 operate at different electrical potentials and it is therefore important that the walls 8 do not electrically connect them. The walls 8 can conveniently be physically attached to the field electrode 7, so that together they form an open box like container within which the cathode filaments 5 are situated.

Figure 2:
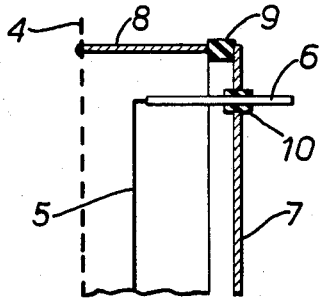
FIG. 2 shows part of it in greater detail.

An alternative construction, which is preferred, is illustrated in FIG. 2. In this arrangement, the walls 8 provide the support for the mesh electrode 4, which is attached to its outer edges. In this case the field electrode 7 consists solely of the back plate through which the pins 6 pass. These pins 6 are electrically insulated from the back plate by means of insulating bushes 10 or the like. In practice, the walls 8 can be mounted upon the back plates, which constitute the field electrodes 7 by means of electrically insulating spacers 9.

Although, in FIG. 1, seven individual cathode filaments are shown, an alternative construction can be used in which an arbitrary number of filaments can be stretched across the back surface of the display arrangement, so as to be mounted above localised back plates of the kind shown in FIG. 1. Walls of the kind shown in FIG. 1, but electrically insulated from the various electrodes, would also be provided in this case, as the walls serve to act as a stencil, and ensure that only predetermined areas of the screen 3 are reached by electrons originating at particular cathodes. This enables a very sharp pattern to be displayed which does not have blurred edges.

In operation, the fluorescent screen 3 is held at a constant potential of about +7 kilovolts, and the mesh electrode 4 is held at a potential of about +10 volts, with respect to the nominal cathode potential. Whilst a display segment is in its "on" state, i.e. whilst light is emitted, the corresponding cathode filament 5 is held at nought volts, and the field electrode 7 is held at +5 volts. Under these considerations the electric field in which the cathode filament 5 is situated is positive with respect to the cathode potential itself, so that electrons are copiously emitted. These electrons are attracted to the mesh electrode 4, since it is held at a positive potential which is greater than that of the field electrode 7. As soon as the electrons pass through the mesh electrode 4 they are very rapidly accelerated under the influence of the high voltage present on the screen 3. In practice, the mesh electrode 4 consists of an array, net or grid of very fine wires, which are spaced apart from each other, so as to be largely physically transparent to electrons. Thus, in practice, most of the electrons emitted by the cathode reach the screen 3, thereby causing it to fluoresce and emit intense light.

Conversely, in order to turn the display "off", i.e. so that it is dark, the potential on the cathode filament 5 is raised to about +10 volts as compared to its previous value, and the potential on the field electrode 7 is altered to −5 volts. The cathode is now situated in a field, (as determined by the potentials on the field electrode 7 and the mesh electrode 4) which is more negative than the potential on the cathode itself. Electron emission is therefore inhibited and virtually no free electrons are available to be accelerated to the mesh electrode 4. In order to ensure that the electric field is sufficiently negative at the cathode, the physical spacing and configuration of the field electrode 7 with respect to the mesh electrode is of great importance, and in practice it is arranged that the cathode is very much closer to the field electrode than to the mesh electrode, so that the effect of the field electrode predominates.

The shape and position of the field electrode 7 with respect to the cathode filament 5 is carefully chosen so that whilst a display segment is in its "on" state, electrons are emitted from the cathode in the form of a divergent flood beam which falls or impinges upon a predetermined locality or area of the mesh electrode. Electrons are accelerated from this locality of the mesh electrode to strike the fluorescent screen 3, and thus to a large extent the area of illumination is determined by the width or solid angle of the divergent flood beam of electrons. This width is also very dependent on the value of the potential difference of the field electrode with respect to that of the cathode. The potential difference during the "off" state which suppresses electron emission is less critical since it is merely necessary to ensure that the field in which the cathode filament is situated has a sufficiently negative value.

Figure 3:
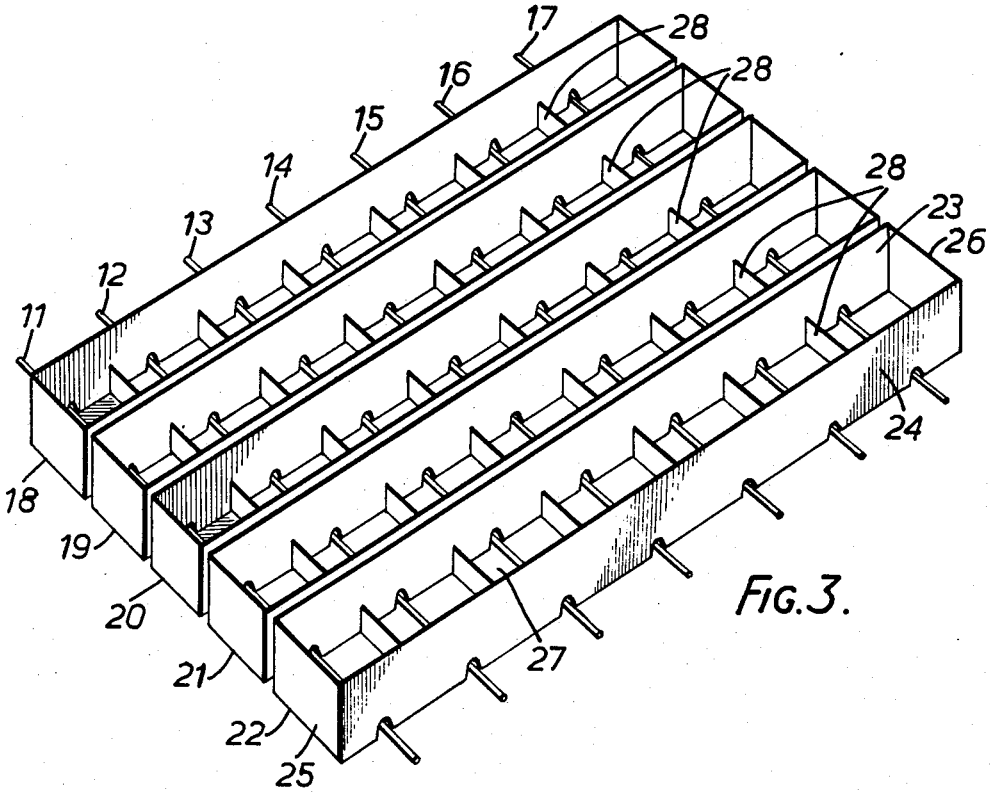
FIG. 3 shows part of a matrix display in accordance with the invention.

An alternative display arrangement is partly shown in FIG. 3. Only the cathode structure and the associated field electrodes are shown, and in practice, a continuous mesh electrode is positioned between the cathode structure and a large fluorescent screen. The arrangement is capable of being operated as a matrix type display; that is to say, a number of individual localised patches of light can be produced which together represent the required display pattern.

The cathode structure consists of seven elongate cathode filaments 11 to 17. Each filament passes through the five field electrode structures 18 to 22, which take the form of open trough like structures with internal partitions. Each field electrode is similar to the others, and consists of two upright major conductive walls 23 and 24 and two upright end conductive walls 25 and 26. A conductive base 27 is connected to the bottom edges of the four walls, and each of the open trough like structures is divided into seven smaller enclosures by six individual partitions 28. Small cut outs are provided at the lower surface of the major walls 23 and 24 to allow the filaments 11 to 17 to pass through without making electrical contact therewith, so that in operation the filaments can be operated at different potentials from those on the field electrodes.

As previously mentioned, a continuous large mesh electrode is positioned in front of the open trough like structures, but mounted so as to be electrically insulated therefrom, and in a manner which is analogous to FIG. 1, a fluorescent screen is positioned in front of this mesh electrode. The five separate field electrodes 18 to 22 and the seven cathode filaments 11 to 17 are in a crossing relationship with each other, having a total of thirty five individual crossing points.

The display arrangement can be operated so as to produce in selected combination of thirty five light patches on the fluroescent screen which correspond to the crossing points. In operation, a constant potential of +10 volts is applied to the mesh electrode. To illuminate a single selected light patch corresponding to the crossing point of a cathode filament and a field electrode, a voltage of +5 volts is applied to that field electrode and nought volts to that particular filament. A bright patch is then produced on the fluorescent screen above the point where the filament and field electrode cross. The remaining cathodes are held at +10 volts and the remaining field electrodes are held at −5 volts. These potentials ensure that electron emission from the cathode filaments is inhibited at all of the other corresponding thirty four possibile patches of illumination.

In practice, these potentials are only approximate, since optimum values will depend on the sizes and shapes of the various electrodes and cathode filaments which are used. Conveniently, the filaments are heated by passing an a.c. current through them from a 3 volt supply. The frequency of the alternating current is chosen so as to avoid flicker frequencies resulting from interference with frequencies used to address the cathode filaments and the field electrodes. Typically, the addressing frequencies are a few hundred hertz, and the frequency of the a.c. current could conveniently be a few kilohertz.

It will be appreciated that altering the potential on the filaments between the two values of nought volts and +10 volts to produce selective illuminating of the screen does not affect the temperature of the filaments, since this is a constant value determined by the magnitude of the a.c. currents flowing through them.

Figure 4:
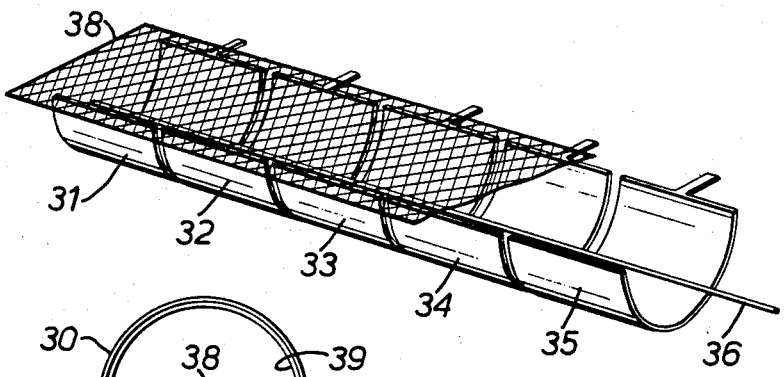
FIGS. 4 and 5 show an elongate display having a number of contiguous sections which can be selectively energised.
Figure 5:
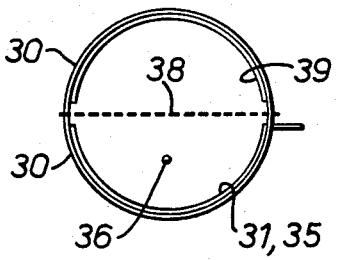

A further form of the display arrangement is shown in FIGS. 4 and 5, in which a part perspective view and section view of a column display are shown. Such a device consists of a single tubular glass envelope 30 carrying five or more curved field electrodes 31 to 35 upon an inner surface thereof, and a single elongate cathode filament 36 positioned along the length of the envelope. The envelope 30 is formed in two halves, and a single long strip of mesh electrode 38 is positioned between them. A region of the upper half of the envelope is provided with a fluorescent coating, upon its inner surface, which thereby acts as a fluorescent screen 39. Such a tube is capable of selectively energising any one or more of five discrete regions of the upper half of the glass envelope. In operation, the mesh electrode 38 is held at a constant potential of +10 volts and the field electrodes 31 to 35 are switched between −5 volts (to inhibit electron emission) to +5 volts (when illumination is required).

This particuar form of construction is very simple to implement as the field electrodes may simply be formed as conductive depositions upon the inner surface of the glass envelope. A number of these column displays can be assembled to form a large two dimensional array of separately controllable light patches.

What I claim is:

1. A display arrangement including a sealed envelope containing a mesh electrode positioned between an electron emissive cathode arranged to emit a divergent flood beam of electrons and a fluorescent screen which forms part of the envelope so that the flood beam falls upon a predetermined area of said mesh electrode; and field electrode means positioned so that the cathode is between at least a part of said means and said mesh electrode, the field electrode means being positioned closely adjacent to the cathode such that the potential difference between the field electrode means and the cathode influences the strength and polarity of the electric field in which the cathode is situated, at least one of said electrode means and said cathode having at least two selectable voltage potentials, whereby the potential difference can be altered between two values to determine respectively whether or not electrons are able to reach said mesh electrode and then said screen to cause it to fluoresce.

2. A display arrangement as claimed in claim 1 and wherein said field electrode means comprises a plurality of separately addressable field electrodes.

3. A display arrangement as claimed in claim 2, wherein said cathode comprises a common cathode filament, and wherein the field electrodes are mounted end to end, and are curved so as to partially surround said common cathode filament.

4. A display arrangement as claimed in claim 3, and wherein said envelope is of an elongate tubular shape, having a flat mesh electrode mounted centrally so as to divide the envelope longitudinally into two segments, one segment containing said field electrodes and said common cathode filament, and the other segment having a coating of fluorescent material upon the interior of its curved surface to constitute said screen.

5. A display arrangement as claimed in claim 1 and wherein said cathode is separately addressable, and further comprising at least one additional separately addressable cathode.

6. A display arrangement as claimed in claim 1 and wherein means are provided for confining the area of the mesh electrode, and hence the area of said screen, which can be reached by emitted electrons.

7. A display arrangement as claimed in claim 6 and wherein said means for confining comprise conductive plates arranged perpendicularly to the plane of the mesh electrode so as to act as stencils.

8. A display arrangement as claimed in claim 7 and wherein said conductive plates are electrically connected to said mesh electrode so as to be at the same potential, and are electrically isolated from said field electrode means.

9. A display arrangement as claimed in claim 7, wherein said cathode comprises a separately addressable cathode filament and said field electrode means comprises a corresponding separately addressable field electrode, said separately addressable cathode filament being mounted immediately in front of said corresponding separately addressable field electrode, and said conductive plates being positioned so as to partially surround said filament.

10. A display arrangement as claimed in claim 7, wherein said field electrode means comprises a plurality of similar field electrodes that are mounted side by side so as to be electrically isolated from each other, wherein said cathode comprises a separately addressable cathode filament, and further comprising at least one additional separately addressable cathode filament, the separately addressable cathode filaments being disposed in crossing relationship with said field electrodes.

11. A method of operating a display arrangement comprising a sealed envelope containing a mesh electrode positioned between an electron emissive cathode arranged to emit a divergent flood beam of electrons and a fluorescent screen which forms part of the envelope so that the flood beam falls upon a predetermined area of said mesh electrode; and field electrode means positioned so that the cathode is between at least a part of said means and said mesh electrode, the field electrode means being positioned closely adjacent to the cathode such that the potential difference between the field electrode means and the cathode influences the strength and polarity of the electric field in which the cathode is situated, at least one of said field electrode means and said cathode having at least two selectable voltage potentials, whereby the potential difference can be altered between two values to determine respectively whether or not electrons are able to reach said mesh electrode and then said screen to cause it to fluoresce including the steps of applying a first predetermined potential difference between the field electrode means and the cathode so as to cause the divergent flood beam of electrons to be emitted from said cathode so as to cause fluorescence of said screen; and applying a second selectable predetermined potential difference between the field electrode means and the cathode so as to prevent electrons reaching the mesh electrode.

* * * * *